US009290888B2

(12) United States Patent
Lienhard et al.

(10) Patent No.: US 9,290,888 B2
(45) Date of Patent: Mar. 22, 2016

(54) RAIL-FASTENING SYSTEM

(75) Inventors: Stefan Lienhard, Konstanz (DE); Daniel Walter, Allensbach (DE); Erik Danneberg, Taegerwilen (CH); Roland Buda, Bodensee (DE)

(73) Assignee: SCHWIHAG AG, Taegerwilen (CH)

( * ) Notice: Subject to any disclaimer, the term of this patent is extended or adjusted under 35 U.S.C. 154(b) by 0 days.

(21) Appl. No.: 14/115,677

(22) PCT Filed: Jun. 11, 2012

(86) PCT No.: PCT/EP2012/002455

§ 371 (c)(1),
(2), (4) Date: Nov. 19, 2013

(87) PCT Pub. No.: WO2012/167947

PCT Pub. Date: Dec. 13, 2012

(65) Prior Publication Data

US 2014/0103132 A1 Apr. 17, 2014

(30) Foreign Application Priority Data

Jun. 10, 2011 (DE) ..... 10 2011 106 363

(51) Int. Cl.

| | |
|---|---|
| ***E01B 9/00*** | (2006.01) |
| ***E01B 9/02*** | (2006.01) |
| ***E01B 9/30*** | (2006.01) |
| ***E01B 9/68*** | (2006.01) |

(52) U.S. Cl.
CPC . *E01B 9/02* (2013.01); *E01B 9/303* (2013.01); *E01B 9/681* (2013.01)

(58) Field of Classification Search
CPC ..... E01B 9/02; E01B 9/681; E01B 9/303; E01B 9/28; E01B 9/30; E01B 9/44
See application file for complete search history.

(56) References Cited

U.S. PATENT DOCUMENTS

| | | | | |
|---|---|---|---|---|
| 5,096,119 | A * | 3/1992 | Schultheiss et al. | 238/349 |
| 5,203,501 | A * | 4/1993 | Vanotti | 238/265 |
| 5,520,330 | A * | 5/1996 | Brown et al. | 238/351 |
| 5,718,376 | A * | 2/1998 | Cox et al. | 238/349 |
| 6,257,495 | B1 * | 7/2001 | Eisenberg | 238/349 |
| 6,595,434 | B1 * | 7/2003 | Seeger | 238/338 |
| 6,830,199 | B1 * | 12/2004 | Jang | 238/310 |
| 7,854,392 | B2 | 12/2010 | Hauschild | |
| 8,408,477 | B2 | 4/2013 | Boesterling | |
| 8,905,323 | B2 * | 12/2014 | Ortmann et al. | 238/349 |
| 2008/0237363 | A1 * | 10/2008 | Hauschild et al. | 238/349 |

(Continued)

FOREIGN PATENT DOCUMENTS

| | | | |
|---|---|---|---|
| CN | 2534221 | Y | 2/2003 |
| CN | 101387090 | A | 3/2009 |

(Continued)

*Primary Examiner* — Jason C Smith
(74) *Attorney, Agent, or Firm* — Andrew Wilford

(57) ABSTRACT

Rail-fastening system for the non-positive resilient fastening of a rail (2) on a sleeper (1) of a railway track installation, comprising at least one angle guide plate (5), which can be fixed to the sleeper (1) with at least one screw (4), and at least one clamp (3), characterized in that the bending radii of the clamp arms (3*a*, 3*b*) of the clamp (3) preferably lie in the range from 18-70 mm, wherein the ratio of mutually adjacent bending radii within each clamping arm is ≤1.9 and the ratio of the greatest to the smallest bending radius thereof is ≤3.8, and in that the ratio of weight to width of the angle guide plate is <1.3 g/mm, preferably about 1.25 g/mm.

9 Claims, 4 Drawing Sheets

(56) References Cited

U.S. PATENT DOCUMENTS

| | | | | |
|---|---|---|---|---|
| 2010/0308123 | A1* | 12/2010 | Bosterling | 238/349 |
| 2011/0042475 | A1 | 2/2011 | Boesterling et al. | |
| 2011/0315784 | A1* | 12/2011 | Bosterling et al. | 238/349 |
| 2012/0080534 | A1* | 4/2012 | Ryou et al. | 238/349 |
| 2012/0111959 | A1* | 5/2012 | Krieg | 238/349 |
| 2012/0111960 | A1* | 5/2012 | Bosterling | 238/349 |
| 2014/0103132 | A1* | 4/2014 | Lienhard et al. | 238/283 |

FOREIGN PATENT DOCUMENTS

| | | | |
|---|---|---|---|
| DE | 3918091 | B | 1/1992 |
| DE | 4034032 | A1 | 4/1992 |
| DE | 4240347 | A | 6/1994 |
| DE | 20008922 | U | 10/2000 |
| DE | 20304291 | U1 | 7/2003 |
| WO | 2006005543 | A | 1/2006 |
| WO | 2009/043822 | A | 4/2009 |

* cited by examiner

Fig. 1a - Prior Art
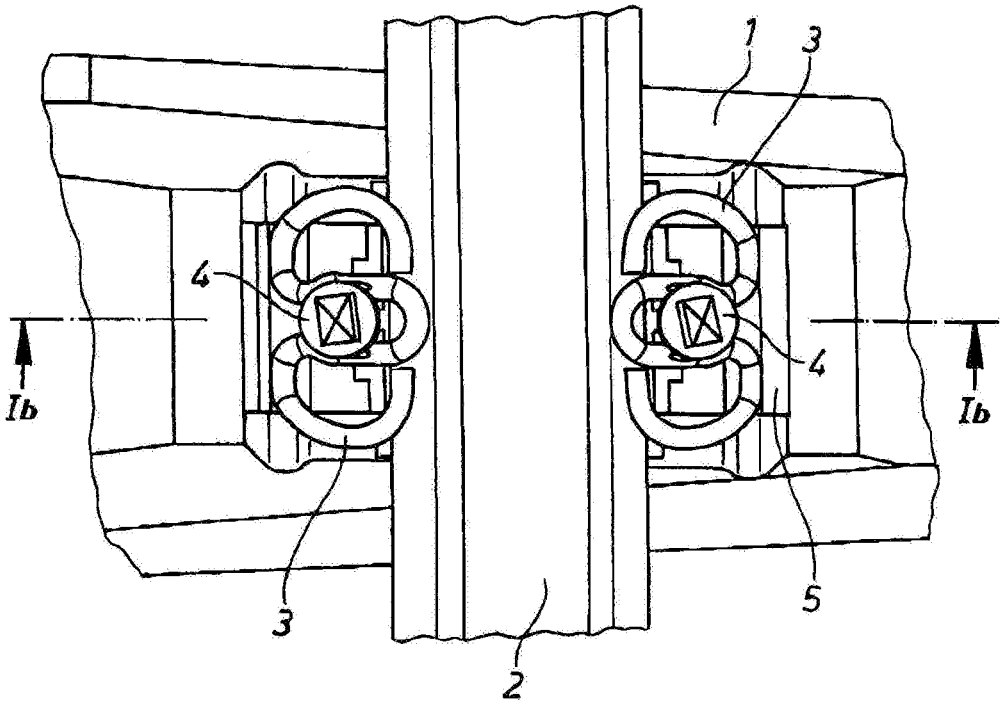
Fig. 1b - Prior Art
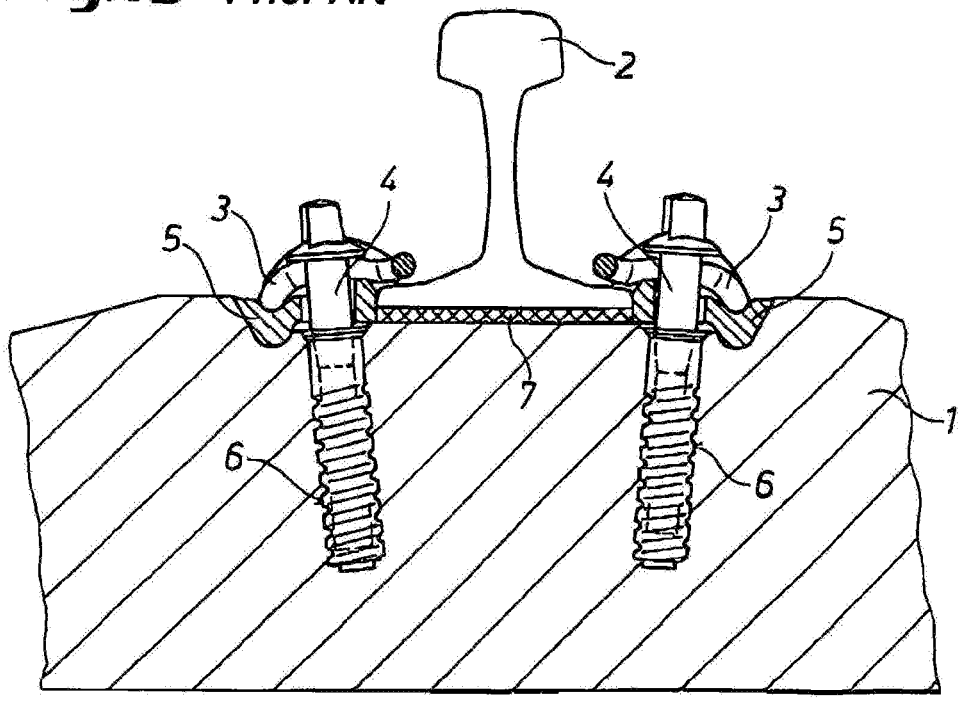

RAIL-FASTENING SYSTEM

CROSS REFERENCE TO RELATED APPLICATIONS

This application is the US-national stage of PCT application PCT/EP2012/002455 filed 11 Jun. 2012 and claiming the priority of German patent application 102011106363.7 itself filed 10 Jun. 2011.

FIELD OF THE INVENTION

The invention relates to a rail-fastening system for the nonpositive elastic fastening of a rail to a railroad tie of a track assembly, comprising at least one angle guide plate that can be fixed by at least one bolt to the railroad tie and at least one clip, with a rail pad produced from a rubber material typically provided between the rail foot and the railroad tie to reliably provide electrical insulation of the track relative to the railroad tie and/or steel elements of the rail-fastening system.

PRIOR ART

Fastening railroad tracks in known track fastening systems is done using bolts, anchors, angle guide plates, and clips. A clip is used that when installed is between an angle guide plate (retaining plate) and a bolt (fastening anchor). The clip here has two projections designed as torsion elements. The torsion projections or projection arms have two parallel adjacent spring-rod sections that are connected as one piece by a loop that creates a clamping section and are essentially bent outward perpendicular thereto.

The purpose of these rail-fastening systems is primarily to fasten rails to a fixed base, for example a concrete railroad tie or plate. The rail to be fastened here is positioned directly on the fixed base over the elastic pad. Lateral guidance of the track is effected by pairs of angle guide plates that create a precise rail channel between them. The angle guide plates transfer forces from the rail directly into the base supporting the rail. To this end, a shoulder (concrete shoulder) is provided for each of the angle guide plates on the respective base, on which shoulder the associated angle guide plate can be supported.

The function of the clip in a rail-fastening system is to clamp the rail against the rail seat of the railroad tie with a predefined force. This clamping force is proportional to the creep resistance and to the torsional resistance of the rail-fastening system. Both resistance forces are critical in providing positional stability of the track assembly. In addition, the clamping force counteracts tilting of the track in response to the occurrence of guide forces from the passage of a vehicle, thus ensuring the requisite track geometry and reliable passage of the vehicle.

A high clamping or biasing force is indispensable specifically in those areas experiencing large lateral guide forces and large fluctuations in temperature. The clip must have both a high clamping force as well as vertical fatigue strength in response to high vertical oscillations since modern rail-fastening systems aid rail elastically in order to distribute the load.

The clips known in the prior art provide, depending on the particular installation situation, have clamping forces of between 10 kn and 14 kn, and a fatigue strength in response to oscillations of up to 2.0 mm (amplitude of the oscillations). Some clips for "slab tracks" constitute an exception and provide a fatigue strength in response to oscillations of up to 3.5 mm, but with a clamping force of only 10 kn.

Tip resistance is affected by the rail-fastening system, and critically here by the width (dimension parallel to the rail foot) of the angle guide plates that transfer the lateral forces from the rail to the shoulders of the railroad tie or concrete sleeper. The torsional resistance of the rail-fastening system is incorporated into the frame rigidity of the track assembly. High frame rigidity must be sought to provide the bearing stability of the continuously welded track (ensuring against buckling).

OBJECT OF THE INVENTION

The object of this invention is therefore to improve the known rail-fastening system in such a way that high connecting forces or biasing forces can be applied, and high lateral forces or stresses acting on the fastenings can be dissipated despite the reduction in weight resulting from optimization of materials.

SUMMARY OF THE INVENTION

According to the invention, clips are used that have the following properties in the region of the clip arms or torsion projections (region between the free end of the clip arms and the rear support): Providing greater bending radii in the clip arms and smaller radius changes enables a uniform stress curve (prevention of peak stresses) to be achieved. At the same time, the clip arms are provided in a flat design, thereby enabling local peak stresses to be prevented within the torsion and bending region. In addition, the rail-fastening system according to the invention uses angle guide plates that have a special geometry that optimally transfers clamping force of the clip to the railroad tie of the track assembly, and also optimally reduces the material used and types of materials used. According to the invention, angle guide plates are thus provided with an oblique surface on their top side facing the clip, and with reinforcements on the bottom side of the angle guide plate facing the railroad tie.

The small radius changes within the clip approximate those of a helical spring (ratio of adjacent radii=1), with the result that local peak stresses can be prevented and the distribution of stress is effected homogeneously over the entire length of the clip arm. From a geometric point of view, it is not possible to configure identical radii (helical bolt) for a clip. Given a continuously approximately equal radius (around 13 to 15 mm, preferably 14.5 mm) for the rod material of the clip, a value of 1.9 is achieved for the ratio of adjacent radii with the radii indicated in FIG. 2*b*. In contrast, the clips known, for example, from the prior art have values significantly greater than 3 in the ratio of adjacent radii, i.e. in the region of strongest bending.

The radii indicated in FIG. 2*b* optimize the distribution of stress, thereby preventing local peak stresses and ensuring little settling behavior by providing a ratio of 3.8 between the largest to the smallest radius in the region of the clip arms. By comparison, the values for the clips known in the art are significantly greater than 7, such as, for example with the clip known in the prior art.

The dimension information in FIGS. 2*a* and 2*c* reveals that the clip arms are provided with a value >2.6 for the ratio between half the clip width (preferably 86 mm) and the height (preferably 33 mm) of the clip.

The ratio according to the invention of >2.6 enables local peak stresses to be prevented that result from superimposition of bending and torsion, and thus allows a higher clamping force and stress amplitude to be achieved using the same materials, specifically, preferably a high clamping force of >14 kn together with a vertical fatigue strength for vibrational displacements (vibration amplitude) of ≥3.5 mm.

The angle guide plates (WFP) used in the rail-fastening is system according to the invention are shown in a top view and multiple sectional views in FIG. 3, as well as in a perspective top view in FIG. 4*a* and in a perspective view from the bottom in FIG. 4*b*. Whereas known angle guide plates (see, for example, German patent specification DE 39 18 091 [U.S. Pat. No. 5,096,119]) include a surface that is parallel to the seat on the railroad tie, which approach necessitates a deflection of the lateral forces to be dissipated through the shoulder, the improved angle guide plate has an oblique surface and reinforcements on the bottom side that are configured parallel thereto. The oblique surface makes possible a direct flow of force without the forces being deflected; instead, the guide forces from the passage of the vehicle over the rail are transferred into the angle guide plate, and perpendicular to the seat from this plate into a shoulder provided on the concrete railroad tie.

The invention furthermore achieves a reduction in weight despite a preferably greater width for the angle guide plate, due to a reduction in material or optimization of material in the less-stressed regions, without weakening the relevant, highly-stressed cross-sections. A standard angle guide plate has a width of 110 m and weight of between 170 g and 180 g (ratio of weight to width of 1.55-1.56). A variant 150 mm wide and having a weight of approximately 230 g (ratio of weight to width of approximately 1.55) is used as a special plate in switch zones. The newly developed angle guide plate according to the invention has a weight of only 190 g with a width of preferably 150 mm, and thus a weight to width ratio of approximately 1.25. The proposed measures according to the invention preferably allow an angle guide plate to be provided that has a width of >110 mm and a ratio of weight to width of <1.3. In addition, the proposed measures according to the invention enable the angle guide plate to be adapted to stronger rail feet and pads while allowing a proportionally smaller increase to be achieved in the use of materials.

The means provided for seating and securing the rail pad in the angle guide plate, preferably side recesses on the angle guide plate, are preferably in the regions of the angle guide plate that are thus not under high load, and are preferably positioned so as to be congruent or aligned with the corners of the pad that is thus optimally secured both horizontally (against slipping out of position) and vertically (against lifting).

BRIEF DESCRIPTION OF THE DRAWING

In the drawing:

FIG. 1*a* is a top view of a prior-art rail-fastening system;

FIG. 1*b* is a section taken along line Ib-Ib of FIG. 1 *a;*

DETAILED DESCRIPTION OF THE INVENTION

Figure 2A:
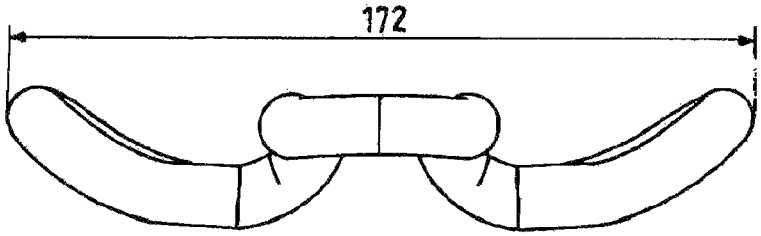
FIGS. 2*a*, 2*b*, 2*c*, and 2*d* are side, end, top, and perspective views of a clip according to the invention.
Figure 2B:
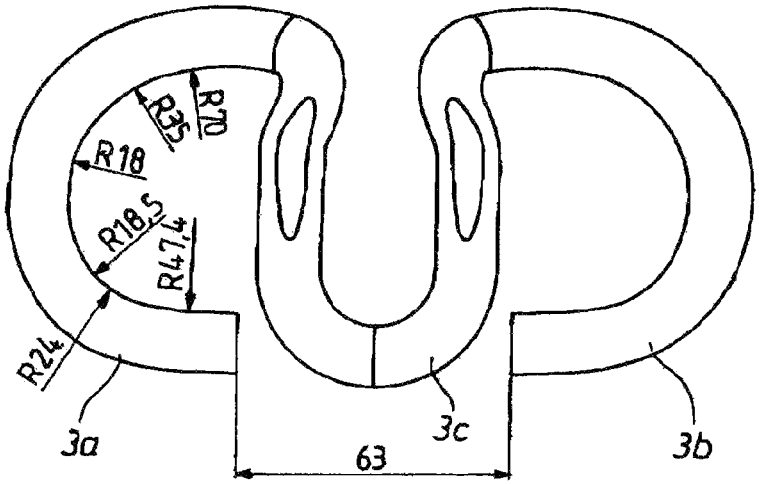
Figure 2C:
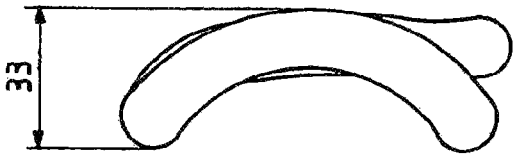
Figure 2D:
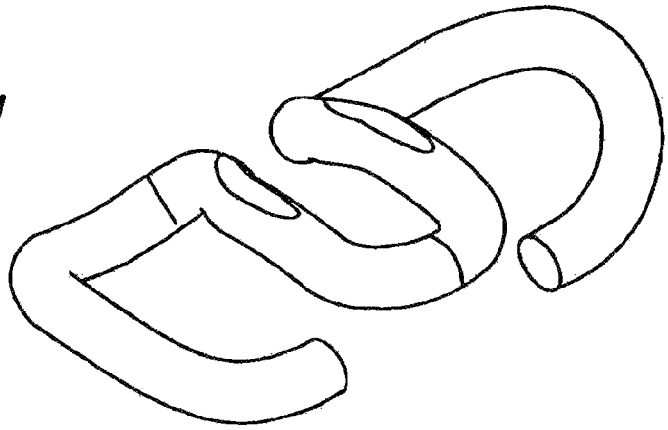

FIGS. 1*a* and 1*b* show a prior-art rail-fastening system specifically, in a top view detail of a track assembly and the fastening of a rail to a concrete railroad tie (FIG. 1*a*), and a section along line Ib-Ib in FIG. 1*b*. A rail 2 laid over a pad 7 on a concrete railroad tie 1 is fixed by clips 3 and railroad tie bolts 4 that are screwed into plastic screw anchors 6 of the concrete railroad tie 1 passing through the center loop of the clips 3, with angle guide plates 5 therebetween. This type of well-established rail-fastening system is significantly improved by installing the clip shown in FIGS. 2*a*-2*d*, and the angle guide plate shown in FIGS. 3*a*-3*f* and 4*a*-4*b* as described above.

FIGS. 2*a*-2*d* shows a clip as used in the rail-fastening system according to the invention. The clip 3 according to the invention has a width of 172 mm (see FIG. 2*a*) and a maximum height of only preferably 33 mm (see FIG. 2*c*). The top view of FIG. 2 reveals that the clip 3 wholly made of rod with a diameter of approximately between 13 mm and 15 mm includes two identical projections (clip arms) 3*a* and 3*b* that are connected to each other through a center loop 3*c*. The railroad tie bolt (not shown here) is the inserted through this center loop 3*c* into the concrete railroad tie (also not shown). The distance between the ends of the projections 3*a* and 3*b* relative to each other preferably measures 63 mm. These symmetrical projections 3*a* and 3*b* are curved to prevent local peak stresses and a ratio of adjacent radii assumes a value of ≤1.9, the radii being between 18.5 mm and 70 mm in this specific embodiment of FIG. 2.

Figure 3A:
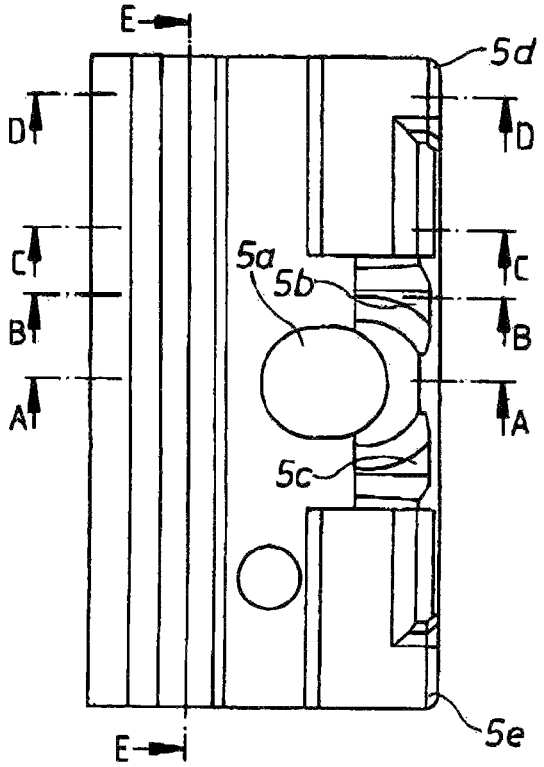
FIG. 3*a* is a top view of an angle plate according to the invention.

FIG. 3*a* is a top view of the angle guide plate 5 according to the invention that has taken on a special shape so as to optimally utilize materials and to transfer forces acting on the angle guide plate 5 through a rail (not shown) into a concrete railroad tie (not shown). A throughgoing bore 5*a* allowing a fastening bolt (not shown) to pass through is provided within the angle guide plate 5 at the center. Seats 5*b* and 5*c* for the center loop of a clip (not shown) are provided flanking the throughgoing bore 5*a*. Recesses 5*d* and 5*e* in the corner regions of left guide plate 5 securely retain a pad (not shown). The purpose of the specific shape of the angle guide plate 5 is to provide a precise reduction in material together with essentially identical or even improved performance.

Figure 3B:
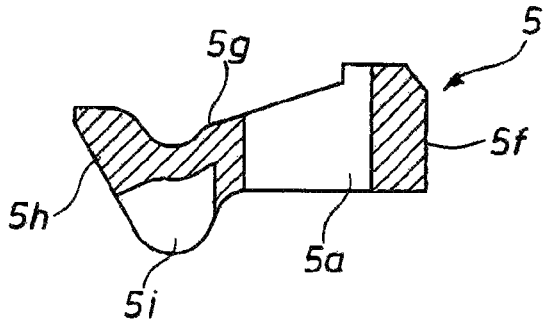
FIGS. 3*b*, 3*c*, 3*d*, 3*e*, and 3*f* are sections taken along respective lines A-A, E-E, B-B, C-C, and D-D of FIG. 3*a*.

FIG. 3*b* is a section along line A-A of FIG. 3*a*, and thus at the center right through the bore 5*a* for the bolt (not shown). A right side face 5*f* of the angle guide plate 5 transmits force from the rail (not shown) especially advantageously into the concrete railroad tie (not shown). On the top side of angle guide plate 5, an oblique surface 5*g* has furthermore been incorporated by which an optimal utilization of material is achieved together with a left side face 5*h* of the angle plate 5 and the reinforcement bump 5*i* on the bottom edge of the side face 5*h*. The side face 5*h* preferably bears in surface contact with a complementarily shaped face (not shown) of a concrete railroad tie so as to achieve an optimal transmission of force from the rail (not shown) into the concrete railroad tie (not shown).

Figure 3C:
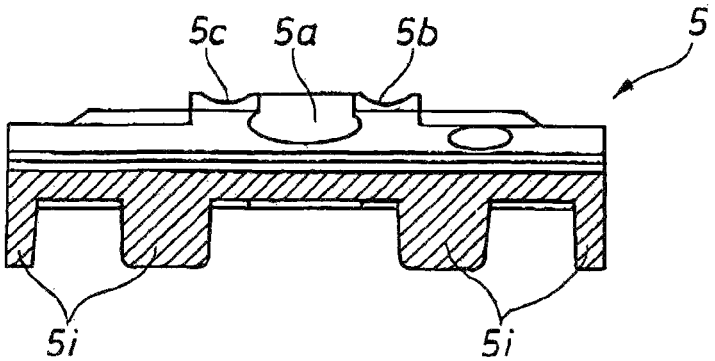

FIG. 3*c* is a section through the angle plate 5 in FIG. 3*a* along line B-B. Respective seats 5*b* and 5*c* for the center loop of the clip (not shown) are provided that flank the bore 5*a* so as to achieve nonslip attachment between the clip (not shown) and the angle plate 5. Four reinforcements ridges 5*i* are formed on the bottom face of the angle plate 5 through appropriate material reduction between these reinforcements 5*i*.

Figure 3D:
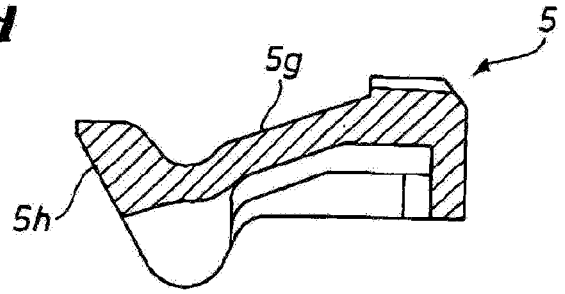
Figure 3E:
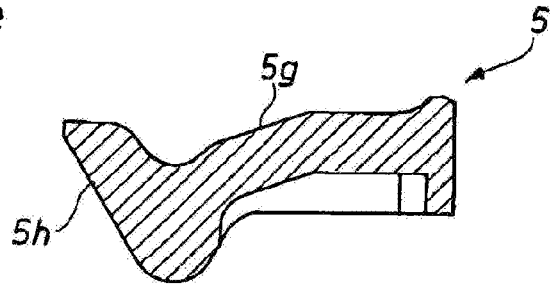
Figure 3F:
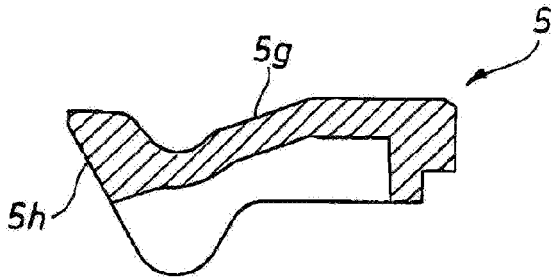

FIGS. 3*d* through 3*f* are sections through the angle plate 5 in FIG. 3*a* along lines C-C (FIG. 3*d*), D-D (FIG. 3*e*), and E-E (FIG. 3*f*). All of the sections in FIGS. 3*d* through 3*f* show that the oblique surface 5*g* on one side and the side face 5*h* on the other side extend continuously across the entire length of the angle plate 5.

Figure 4A:
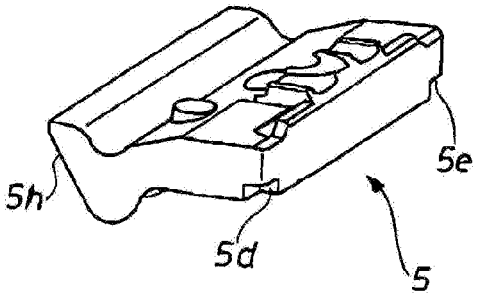
FIGS. 4*a* and 4*b* are perspective top and bottom views of the angle plate of this invention.
Figure 4B:
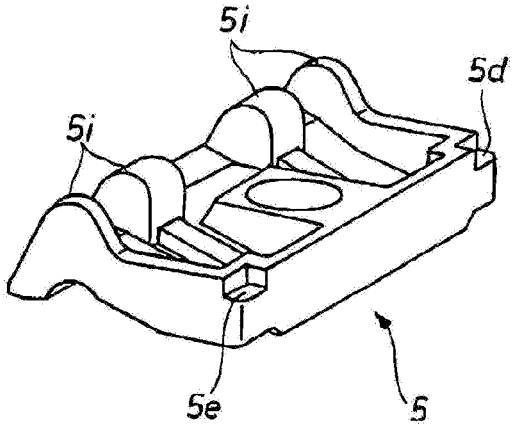

Finally, FIG. 4*a* and 4*b* are perspective views from above (FIG. 4*a*) and from below (FIG. 4*b*) of the angle plate 5 according to the invention. The angle plate 5 includes the above-described recesses 5*d* and 5*e* at the corners opposite the face 5*h*, which recesses function to secure a pad (not shown). While maintaining the required safety standard, material has been reduced between reinforcements 5*i* through which force is transferred into the concrete railroad tie (not shown), in particular, a shoulder (not shown) on a concrete railroad tie, thereby optimizing the overall weight of the angle plate 5.

The invention claimed is:

1. A rail-fastening system for the nonpositive elastic fastening of a rail to a railroad tie of a track assembly, comprising at least one angle guide plate that can be fixed by at least one bolt to the railroad tie, and at least one clip having clip arms pressing the rail downward onto the tie, wherein the clip arms of the clip have multiple bend radii, a ratio of mutually adjacent bending radii for each clip arm is ≤1.9, a ratio of the longest bending radius to the shortest bending radius is ≤3.8, and a ratio of weight to width for the angle guide plate is <1.3 g/mm.

2. The rail-fastening system defined in claim 1, wherein a rail pad composed of electrically insulating material is provided between the rail foot and the railroad tie in order to insulate the rail from the railroad tie or from electrically conductive materials, preferably, steel elements of the rail-fastening system.

3. The rail-fastening system defined in claim 1, wherein the clip is formed of rod material having a generally uniform diameter in the range between approximately 13 mm and 15 mm.

4. The rail-fastening system defined in claim 1, wherein a clamping force of the clip is >14 kn, while the clip has a vertical fatigue strength for vibrational displacements with an amplitude of ≥3.5 mm.

5. The rail-fastening system defined in claim 1, wherein a top side of the angle guide plate has an oblique face and a bottom side of the plate has reinforcements.

6. The rail-fastening system defined in claim 1, wherein a width of the angle guide plate is >110 mm.

7. The rail-fastening system defined in claim 1, wherein the ratio between half a clip width and a height of the clip is >2.6.

8. The rail-fastening system defined in claim 1, wherein the angle guide plate includes recesses to receive and secure the rail pad.

9. The rail-fastening system defined in claim 1, wherein the bend radii range between 18 mm and 70 mm.

* * * * *